US010064437B2

(12) United States Patent
Brownell et al.

(10) Patent No.: US 10,064,437 B2
(45) Date of Patent: Sep. 4, 2018

(54) BRA PAD FOR LARGE BUSTS

(71) Applicant: DOUBLE SCOOP, LLC, Santa Barbara, CA (US)

(72) Inventors: Annabelle Abba Brownell, Santa Barbara, CA (US); Betsy Catya Heafitz, Santa Barbara, CA (US)

(73) Assignee: Double Scoop, LLC, Santa Barbara, CA (US)

( * ) Notice: Subject to any disclaimer, the term of this patent is extended or adjusted under 35 U.S.C. 154(b) by 78 days.

(21) Appl. No.: 15/156,181

(22) Filed: May 16, 2016

(65) Prior Publication Data

US 2017/0325517 A1 Nov. 16, 2017

(51) Int. Cl.
*A41C 3/14* (2006.01)
*A41C 3/08* (2006.01)

(52) U.S. Cl.
CPC ..... *A41C 3/144* (2013.01); *A41C 3/08* (2013.01)

(58) Field of Classification Search
CPC ..... A41C 3/144; A41C 3/10; A41C 3/0057; A41C 3/0007; A41C 3/065; A41C 3/008
USPC ..... 450/54–57, 38, 39; 2/267, 268
See application file for complete search history.

(56) References Cited

U.S. PATENT DOCUMENTS 2,342,076 A * 2/1944 Herbener ..... A41C 3/144 450/56
2,563,241 A * 8/1951 Herbener ..... A41C 3/144 2/267
2,664,571 A * 1/1954 Kempel ..... A41C 3/144 450/57
2,834,352 A * 5/1958 Ullian ..... A41C 3/10 450/57
3,247,853 A * 4/1966 Sloate ..... A41C 3/10 450/55
3,620,222 A * 11/1971 Block ..... A41C 3/144 450/57
3,814,107 A * 6/1974 Greenblatt ..... A41C 3/10 450/56
3,834,397 A * 9/1974 Birch ..... A41C 3/10 450/56
D462,153 S * 9/2002 Nadsady ..... D2/706
6,814,647 B1 * 11/2004 Huang ..... A41C 3/14 2/267
6,824,444 B2 * 11/2004 Huang ..... A41C 3/0007 450/39
7,922,560 B2 * 4/2011 Avalos-Dessner ..... A41C 3/10 2/267
8,216,021 B1 * 7/2012 MacKinnon ..... A41C 3/10 450/54
8,221,189 B2 * 7/2012 Chen ..... A41C 3/065 450/54
8,262,433 B2 * 9/2012 Castellano ..... A41C 3/144 2/267
8,672,728 B2 * 3/2014 Chan ..... A41C 3/144 450/54
9,011,199 B2 * 4/2015 Yuasa ..... A41C 3/10 450/53

(Continued)

*Primary Examiner* — Gloria Hale
(74) *Attorney, Agent, or Firm* — Knobbe Martens Olson & Bear LLP

(57) ABSTRACT

A pushup pad for brassieres, dresses, tops, athletic wear, swimwear, and other garments. The right and left pads are mirror images of each other and not interchangeable. The pad enhances the cleavage of cup sizes D and above without substantially adding volume.

20 Claims, 5 Drawing Sheets

(56) References Cited

U.S. PATENT DOCUMENTS

| | | | | |
|---|---|---|---|---|
| 2003/0181129 | A1* | 9/2003 | Getman | A41C 3/0057 450/57 |
| 2006/0252343 | A1* | 11/2006 | Jian | A41C 3/10 450/54 |
| 2010/0022163 | A1* | 1/2010 | Widell | A41C 3/10 450/39 |
| 2010/0041313 | A1* | 2/2010 | Castellano | A41C 3/144 450/39 |
| 2010/0273395 | A1* | 10/2010 | Castellano | A41C 3/144 450/39 |
| 2013/0303051 | A1* | 11/2013 | Chan | A41C 3/144 450/57 |
| 2014/0154948 | A1* | 6/2014 | Yuasa | A41C 3/10 450/55 |

* cited by examiner

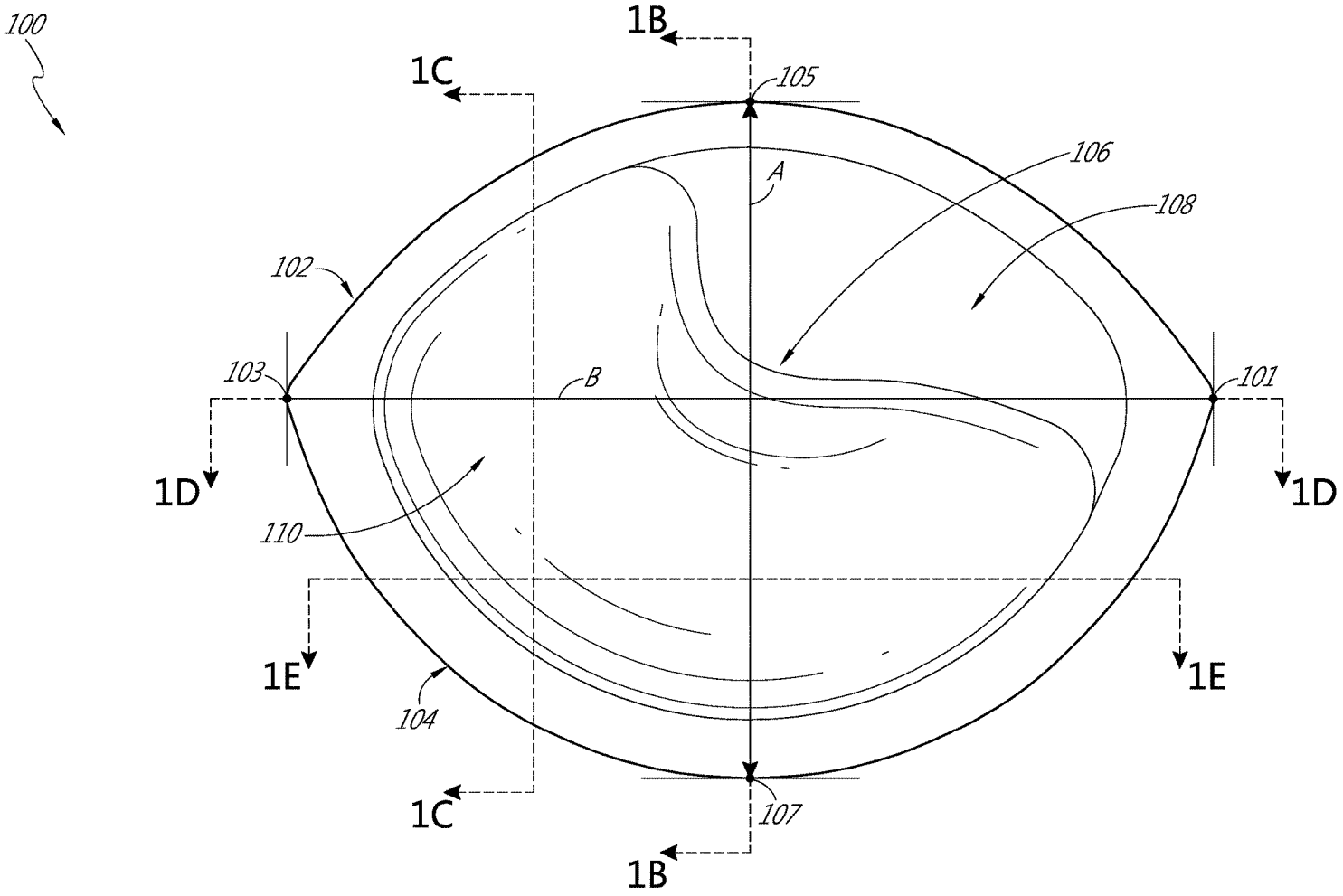
FIG. IA

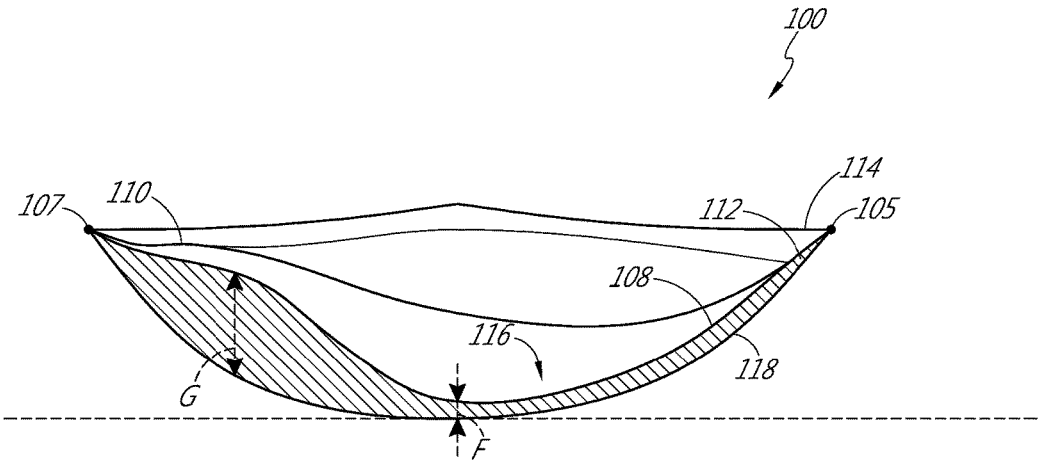
FIG. IB
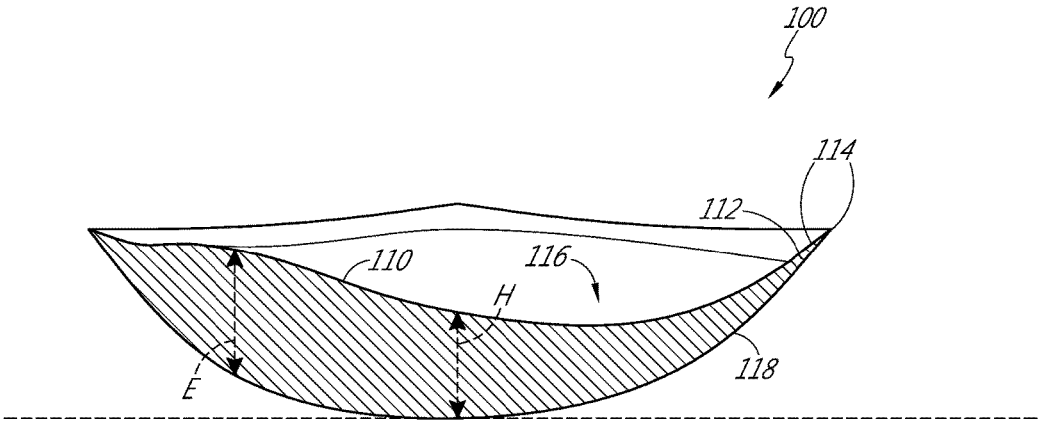
FIG. IC

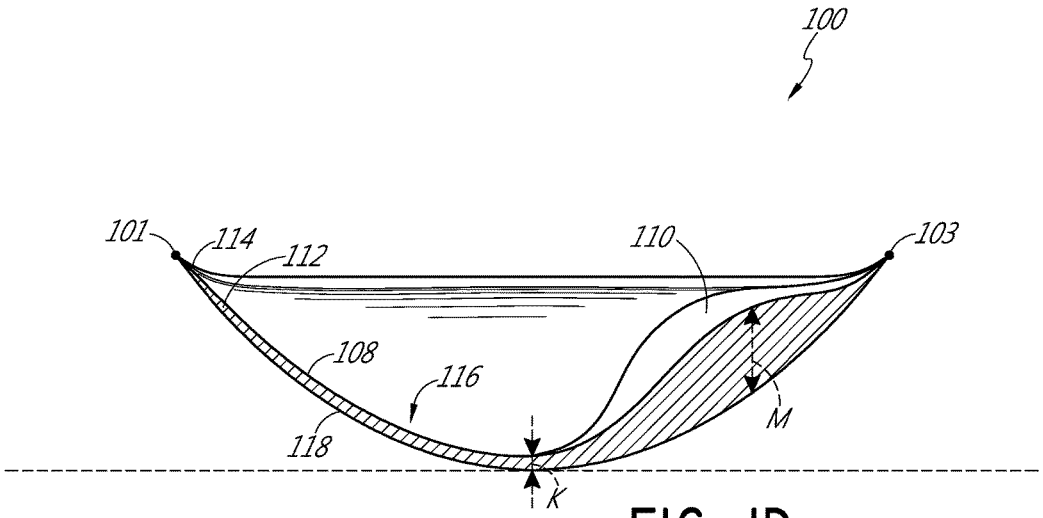
FIG. ID
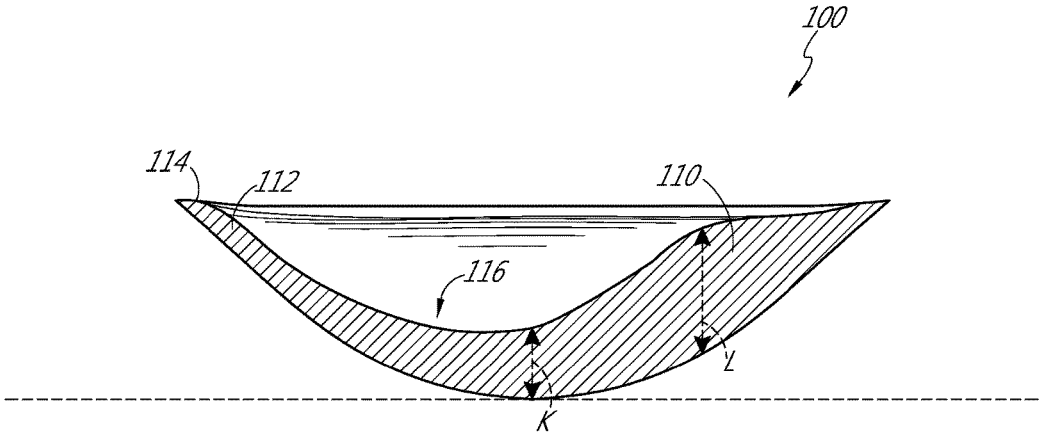
FIG. IE

BRA PAD FOR LARGE BUSTS

BACKGROUND

Field

The invention relates to a pushup pad for brassieres, dresses, tops, athletic wear, swim suits, and other garments.

Description of the Related Art

A bra is an undergarment worn by a person to support the breasts. Pushup pads can be added to a bra and generally push up or elevate the breast and add volume to give the appearance of a larger cup size.

SUMMARY

The devices, systems, and methods disclosed herein have several features, no single one of which is solely responsible for its desirable attributes. Without limiting the scope as expressed by the claims that follow, its more prominent features will now be discussed briefly. After considering this discussion, and particularly after reading the section entitled "Detailed Description" one will understand how the features of the system and methods provide several advantages over traditional systems and methods.

There is a need for an improved insert design for use by women having large busts, for example, D cup and above, to enhances the cleavage by simultaneously lifting and bringing the breasts closer together without adding substantial volume.

In accordance with one aspect, a removable pad for use with a bra, swimsuit, dress, or top to enhance a person's cleavage is provided. The pad comprises an insert having a generally oval outer profile and having a size generally corresponding to a D-size cup or larger. The insert is asymmetric in thickness about a central axis of the insert. The insert has a thickness that is greater in three-quarters of the circumference of the insert than in a remaining quarter of the circumference, said thickness increasing from an outer edge of the insert to a maximum thickness at a radial location between the outer edge of the insert and the central axis of the insert, said thickness decreasing from said maximum thickness to a thickness proximate the central axis of the insert. The pad further optionally comprises a fabric cover that encloses the insert. The pad lifts and supports the person's breast to enhance the person's cleavage without substantially adding to the volume provided by the bra, swimsuit, dress or top to the person's breast.

In accordance with another aspect, a pair of removable left and right pads for use with a bra, swimsuit, dress, or top to enhance a person's cleavage are provided. The pads comprise a left insert having a generally oval outer profile and having a size generally corresponding to a D-size cup or larger. The insert is asymmetric in thickness about a central axis of the left insert, the left insert having a thickness that is greater in three-quarters of the circumference of the left insert than in a remaining quarter of the circumference. Said thickness increases from an outer edge of the left insert to a maximum thickness at a radial location between the outer edge of the left insert and the central axis of the left insert, said thickness decreasing from said maximum thickness to a thickness proximate the central axis of the left insert. The pads also comprise a right insert having a generally oval outer profile and having a size generally corresponding to a D-size cup or larger. The right insert is asymmetric in thickness about a central axis of the right insert, the right insert having a thickness that is greater in three-quarters of the circumference of the right insert than in a remaining quarter of the circumference. Said thickness increases from an outer edge of the right insert to a maximum thickness at a radial location between the outer edge of the right insert and the central axis of the right insert, said thickness decreasing from said maximum thickness to a thickness proximate the central axis of the right insert. The left and right pads are not interchangeable in use.

BRIEF DESCRIPTION OF THE DRAWINGS

The disclosed aspects will hereinafter be described in conjunction with the appended drawings, provided to illustrate and not to limit the disclosed aspects, wherein like designations denote like elements.

FIG. 1A is a top view of the inner surface of an embodiment of a pad for a person's left side.

FIG. 1B is a cross-sectional view of the pad illustrated in FIG. 1, taken along line 1B.

FIG. 1C is a cross-sectional view of the pad illustrated in FIG. 1, taken along line 1C.

FIG. 1D is a cross-sectional view of the pad illustrated in FIG. 1, taken along line 1D.

FIG. 1E is a cross-sectional view of the pad illustrated in FIG. 1, taken along line 1E.

DETAILED DESCRIPTION

Figure 2:
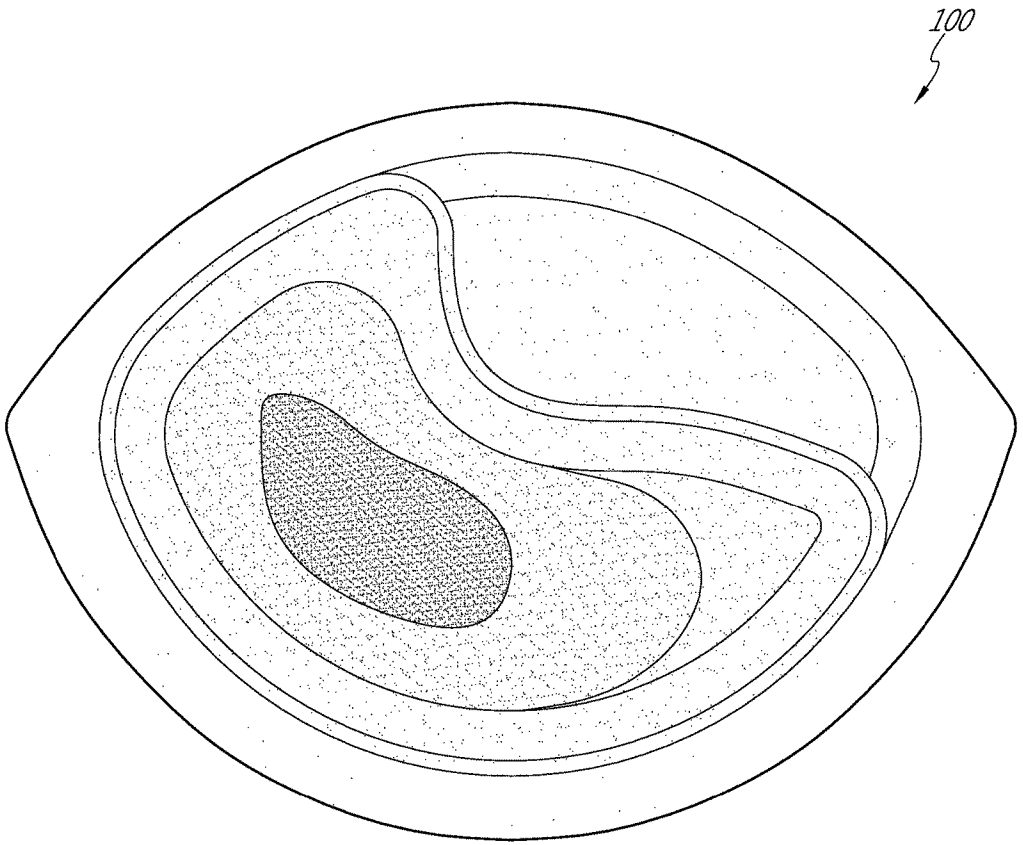
FIG. 2 is a gradient map of the inner surface of the pad illustrated in FIG. 1.

Bra pads are typically designed for small busts, for example, A to C cup sizes. Embodiments disclosed herein describe a bra pad that is designed for large busts, for example, D cup and above. The bra pad adds support for large breasts that may sag due to their larger size. Throughout this specification, the reference to large breasts or large busts will refer to U.S. cup sizes D and above. People with large busts do not need added volume, but may want enhanced cleavage. The bra pad enhances the cleavage by simultaneously lifting and bringing the breasts closer together without adding substantial volume. The bra pad can provide shapely support and nipple coverage. The bra pad can be used with dresses, tops, athletic wear, bras, and swimsuits. The bra pad can turn any bra into a push-up bra. The bra pads can also be used without a bra.

The bra pads are designed for left and right sides and are not interchangeable. The left and right pads are mirror images of each other. By having left and right sides, the pair of pads provides a boost and brings the breasts more front and center, maximizing the cleavage of large busts without substantially adding to the size of woman's bust.

The bra pads can be placed towards the outside of the breasts as opposed to being centered on the nipple. The nipple would be positioned in an off-center location of the pad. Being positioned on the outside of the breasts, the pads can move the breasts closer together at the same time as adding lift. When used inside a bra or garment, the bra or garment bears against the outer surface of the pad, which due to the geometry of the padding in the pad lifts and pushes the breast inward and upward.

In one embodiment, the pads can include an insert made of lightweight foam. Optionally, the insert can be made from a monolithic piece of foam. In another embodiment, the insert can be made from layers of foam (e.g., multiple layers of foam, or a multi-layered foam structure). However, in other embodiments, the insert can be made of other suitable materials (e.g., silicone). The pads can have a fabric cover that encloses the insert. The pads can be used in water (e.g., worn beneath a swimsuit). The pads can be placed in a pocket in the garment or bra, sewn onto the garment or bra, or attached with removable adhesive, such as glue or tape. The pads can be used without adhesive. The pads can be used without a bra.

The exterior (e.g., front facing surface) of the pad has a generally convex surface. From the exterior view, it is not noticeable where the padding is positioned. The pad has an interior cavity that receives at least a portion of the breast. The positioning of the padding is noticeable when viewing the interior of the pad. The padding is asymmetrical in thickness about a central axis. The pad has a thickness that is greater in three quarters of the pad than in the remaining quarter of the pad. The largest thickness of the pad can be between about 2.5 cm and 2.7 cm. In some embodiments, the largest thickness of the pad is about 2.6 cm. In some embodiments, the pads are the thinnest at the edges. In some embodiments, the remaining quarter of the pad has the same or substantially similar thickness as the edge. The smallest thickness of the pad can be between about 0.05 cm and 0.15 cm. In some embodiments, the smallest thickness of the pad can be about 0.10 cm. However, the pad can have other suitable thicknesses.

Figure 3:
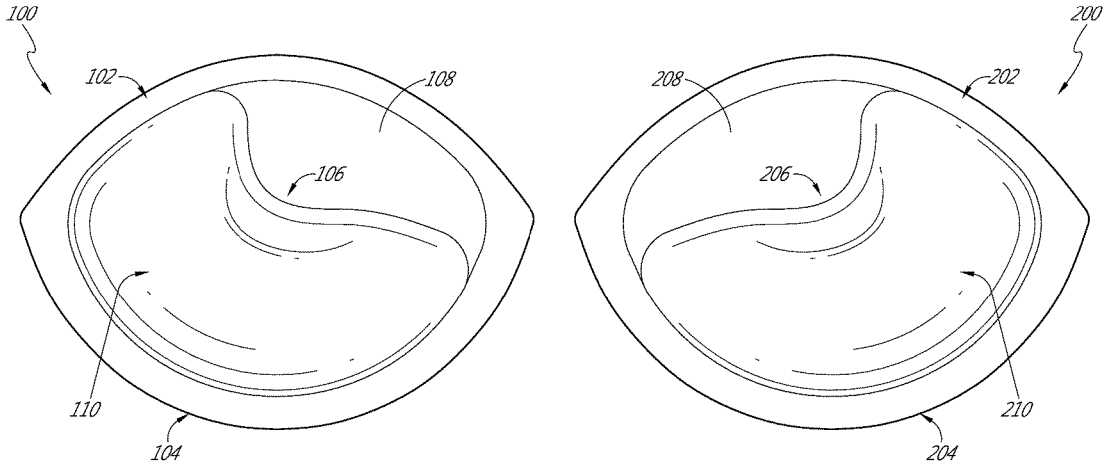
FIG. 3 is a top view of the inner surfaces of embodiments of pads for a person's left and right sides.

FIG. 1A illustrates the inner surface (e.g., rearward facing surface) of an embodiment of a pad 100 for the left breast. A pad 200 for the right breast is a mirror image of the pad 100 for the left breast. Embodiments of both pads 100 and 200 are illustrated in FIG. 3. When used, the inner surface of the pad 100 is placed against the left breast. The pad 100 is placed partially on the outside of the left breast and is not centered on the nipple. The region 108 can be positioned on the breast to receive the nipple. Placement towards the outside or lateral portion of the breast enhances comfort and support for large breasts. Point 101 is on the right side or medial part of the pad 100; this part will be placed closer to the midline of the user's body and closer to the front of the breast. Point 103 is on the left side or lateral part of the pad 100; this part will be placed farther from the midline of the user's body and closer to the side of the breast. Point 105 is on the top or superior portion of the pad 100. Point 107 is on the bottom or inferior portion of the pad 100. The bottom portion will be placed below the breast to help support and lift the larger breast.

The pad has a generally oval shape (e.g., outer perimeter). The length B (horizontal diameter) can be between about 22 cm and 22.5 cm. In some embodiments, the length B can be about 22.3 cm. The height A (vertical diameter) can be between about 17 cm and 17.8 cm. In some embodiments, the height A can be about 17.5 cm. The circumferential length of the top edge 102 (between points 101 and 103) is less than the circumferential length of the bottom edge 104 (between points 101 and 103). The circumferential length of the top edge 102 can be between about 21 cm and 21.5 cm. In some embodiments, the circumferential length of the top edge 102 is about 21.3 cm. The circumferential length of the bottom edge 104 can be between about 25 cm and 26 cm. In some embodiments, the circumferential length of the bottom edge 104 can be about 25.6 cm. However, other suitable dimensions are possible.

The pad 100 has a relatively more padded region 110 and a relatively less padded region 108. The padding is asymmetric about a central axis 106. The padded region 110 covers about three quarters of the circumference of the pad 100. The padded region 110 is positioned on the lateral half of the pad and the inferior half of the pad. In the illustrated embodiment, the padded region 110 does not extend to the edge of the pad 100. There may be a region of less padding around the edge of the pad. The region of less padding around the bottom edge 104 may be stiffer than the padded region 110. This stiffer region may help decrease the visibility of the pad and provide support for a larger breast. In other embodiments, the padded region 110 extends to the edge of the pad 100.

In some embodiments, the less padded region 108 has little to no padding. In some embodiments, the less padded region 108 has substantially the same thickness as the edge of the pad 100. The less padded region 108 can cover about one quarter of the circumference of the pad 100. As shown in FIG. 1A, the less padded region 108 is in not centered about central axis 106. The less padded region 108 can be positioned off-center of the pad 100 because when used the pad is positioned towards the outside of the breast and is not centered on the nipple.

Line 1B is near the vertical centerline of the pad 100. Line 1B is near the transition from the superior part of the padded region 110 to the less padded region 108. Line 1B also cuts through the inferior part of the padded region 110.

Line 1C is near the thickest portion of the lateral part of the padded region 110.

Line 1D is near the horizontal centerline of the pad 100. Line 1D is near the transition from the medial part of the padded region 110 to the less padded region 108. Line 1D also cuts through the lateral part of the padded region 110.

Line 1E is near the thickest portion of the inferior part of the padded region 110.

FIG. 1B is a cross-sectional view of an embodiment of a left pad, taken near the vertical centerline of the pad 100. The outer surface 118 of the pad is arcuate and smooth. The pad 100 has an inner cavity 116 that is located in the top right portion of the pad 100. The pad 100 has an inner cavity 116 that is located in the inferior medial quarter of the pad 100. The inner cavity 116 receives part of the left breast. The pad 100 can be made of foam 112 and covered by a fabric liner 114 on both sides of the foam.

In FIG. 1B, the top or superior portion is on the right of the figure and the bottom or inferior portion is on the left of the figure. The relatively more padded region 110 is on the left of the figure and the relatively less padded region 108 is on the right of the figure. The thickness of the pad increases when moving in a radial direction from a thickness F to a thickness G. The thickness decreases when moving in a radial direction from thickness G to the edge of the pad at point 107. The thickness of the less padded region 108, on the right, is substantially constant. A thicker portion of the padded region 110 is visible.

FIG. 1C is a cross-sectional view of an embodiment of a left pad 100, taken near the thickest portion of the lateral part of the padded region 110. In FIG. 1C, the top or superior portion is on the right side of the figure and the bottom or inferior portion is on the left side of the figure. The relatively more padded region 110 does not have a constant thickness along the cross-section; rather, the thickness of the padded region 110 varies across the padded region 110. The padded region 110 is thicker on the inferior portion of the pad 100 than the superior portion. The inferior portion of the pad has a greater thickness to support and lift a large breast and enhance the cleavage without adding substantial volume. The thickness of the pad increases when moving in a radial direction from a thickness H to a thickness E. The thickness decreases when moving in a radial direction from a thickness E to the inferior edge of the pad. The thickness decreases when moving in a radial direction from a thickness H to the superior edge of the pad.

FIG. 1D is a cross-sectional view of an embodiment of a left pad 100, taken near the horizontal centerline 1D of the pad 100. The outer surface 118 is arcuate and smooth. In FIG. 1D, the medial portion of the pad is on the left side of the figure and the lateral portion is on the right side of the figure. The inner cavity 116, which receives the breast, is on the left side of the figure. The relatively less padded region 108 is on the left side of the figure. The lateral portion of the relatively more padded region 110 is on the right side of the figure. A thicker part of the padded region 110 is visible.

Along the cross-sectional line 1D, the thickness of the pad increases when moving radially from a thickness K to a thickness M. A thicker portion of the pad is visible behind thickness M. The thickness of the pad decreases when moving radially from thickness M to the edge at point 103. The thickness of the less padded region 108, on the left, is substantially constant.

FIG. 1E is a cross-sectional view of an embodiment of a left pad 100, taken near the thickest portion of the inferior or bottom part of the padded region 110. In FIG. 1E, the medial portion of the pad 100 is on the left side of the figure and the lateral portion is on the right side of the figure. The relatively more padded region 110 does not have a constant thickness along the cross-section; rather, the thickness of the padded region 110 varies across the padded region 110. The padded region 110 is thicker on the lateral portion of the pad 100 than the medial portion. The lateral portion of the pad 100 has a greater thickness to push a larger breast inward and enhance the cleavage without adding substantial volume. The thickness of the pad increases when moving in a radial direction from a thickness K to a thickness L. The thickness decreases when moving in a radial direction from a thickness L to the edge of the pad. The thickness decreases when moving in a radial direction from a thickness K to the edge of the pad.

FIG. 2 is a gradient map of the inner surface of the left pad 100. The gradient map illustrates the thickness of the inner surface, specifically how the thickness changes from a relatively less padded area to a relatively more padded area, how the thickness changes in the relatively more padded area, and how the thickness changes from the padded area to the edge. The gradient map illustrates how approximately three-quarters of the pad has a greater thickness than approximately one-quarter of the pad. The area with greatest thickness is in the outer and lower part of the pad. This geometry of padding lifts and pushes the breast inward without adding substantial volume.

The inner surfaces of embodiments of both pads are shown in FIG. 3. The pad for the right breast 200 is a mirror image of the pad for the left breast 100 and has corresponding features. Accordingly, the description above for the features of the left pad 100 is equally applicable to the right pad 200, though the features in the right pad 200 are mirror images of the features in the left pad 100. Accordingly, the right and left pads 100, 200 are not interchangeable. The right pad 200 has a top edge 202 and a bottom edge 204. The right pad 200 is asymmetrical about central axis 206. The right pad 200 has a relatively more padded region 210 and a relatively less padded region 208. The padded region 210 covers about three-quarters of the circumference of the pad, including bottom edge 204 and part of top edge 202. The padded region 210 can be located on the outer or lateral portion of the pad 200 and the bottom or inferior portion of the pad 200. When used, the right pad 200 is positioned towards the outside of the right breast and is not centered on the nipple. The placement of the pad on the outside of the breast helps to enhance the cleavage of large busts by pushing the breasts closer together and providing shapely support for the larger bust.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A removable pad configured to enhance a person's cleavage, comprising:

an insert having a generally oval outer perimeter that extends from a lateral end to a medial end of the insert and having a size generally corresponding to a D-size cup or larger breast cup, the insert being asymmetric in thickness about a central axis extending horizontally across the insert, the insert having a thicker portion with a thickness that is greater in three-quarters of an area spanned by the insert from the lateral end to the medial end of the insert and a thinner portion in a remaining quarter of the area spanned by the insert from the lateral end to the medial end of the insert, said thickness increasing from an outer edge of the insert to a maximum thickness at a location between the outer edge of the insert and the central axis of the insert, said thickness decreasing from said maximum thickness to a thickness proximate the central axis of the insert, wherein said thickness is measured from an inner surface of the insert configured to face toward a person's breast when in use, to an outer surface of the insert configured to face away from the person's breast when in use, wherein the thicker portion of the pad is configured to lift and support the person's breast to increase the person's cleavage.

2. The pad of claim 1, wherein the insert is made out of foam.

3. The pad of claim 2, wherein the insert is made out of a monolithic piece of foam.

4. The pad of claim 1, wherein said remaining quarter of the area spanned by the insert is configured to receive a nipple of the person's breast.

5. The pad of claim 1, wherein said thickness is continuously increasing between the outer edge and the maximum thickness.

6. The pad of claim 1, wherein said thickness is continuously decreasing between the maximum thickness and a thickness at the central axis of the insert.

7. The pad of claim 1, wherein said maximum thickness is between 2.5 cm and 2.7 cm.

8. The pad of claim 1, wherein a minimum thickness is between 0.05 cm and 0.15 cm, wherein the minimum thickness is located at an outer edge of the insert or at said remaining quarter of the area spanned by the insert.

9. The pad of claim 1, wherein said maximum thickness is about 2.6 cm.

10. The pad of claim 1, wherein said minimum thickness is about 0.1 cm, wherein the minimum thickness is located at an outer edge of the insert or at said remaining quarter of the area spanned by the insert.

11. A pair of removable left and right pads configured to enhance a person's cleavage, comprising:

a left insert having a generally oval outer perimeter that extends from a lateral end to a medial end of the left insert and having a size generally corresponding to a D-size cup or larger breast cup, the left insert being asymmetric in thickness about a central axis extending horizontally across the left insert, the left insert having a thicker portion with a thickness that is greater in three-quarters of an area spanned by the left insert from the lateral end to the medial end of the left insert and a thinner portion in a remaining quarter of the area spanned by the left insert from the lateral end to the medial end of the left insert, said thickness increasing from an outer edge of the left insert to a maximum thickness at a location between the outer edge of the left insert and the central axis of the left insert, said thickness decreasing from said maximum thickness to a thickness proximate the central axis of the left insert, wherein said thickness is measured from an inner surface of the left insert configured to be adjacent a person's breast when in use to an outer surface of the left insert configured to face away from the person's breast when in use;

a right insert having a generally oval outer perimeter that extends from a lateral end to a medial end of the right insert and having a size generally corresponding to a D-size cup or larger breast cup, the right insert being asymmetric in thickness about a central axis extending horizontally across the right insert, the right insert having a thicker portion with a thickness that is greater in three-quarters of an area spanned by the right insert from the lateral end to the medial end of the right insert and a thinner portion in a remaining quarter of the area spanned by the right insert from the lateral end to the medial end of the right insert, said thickness increasing from an outer edge of the right insert to a maximum thickness at a location between the outer edge of the right insert and the central axis of the right insert, said thickness decreasing from said maximum thickness to a thickness proximate the central axis of the right insert, wherein said thickness is measured from an inner surface of the right insert configured to be adjacent a person's breast when in use, to an outer surface of the right insert configured to face away from the person's breast when in use;

wherein the left and right pads are not interchangeable in use, and wherein the thicker portions of the left and right inserts are configured to lift and support the person's left and right breasts to enhance the person's cleavage.

12. The pads of claim 11, wherein the left and right pads are mirror images of each other.

13. The pads of claim 11, wherein the inserts are made out of foam.

14. The pads of claim 13, wherein the inserts are made out of a monolithic piece of foam.

15. The pads of claim 11, wherein said remaining quarter of the area spanned by the left insert is configured to receive a nipple of a left breast of the person and said remaining quarter of the area spanned by the right insert is configured to receive a nipple of a right breast of the person.

16. The pads of claim 11, wherein said thickness of the left insert is continuously increasing between the outer edge of the left insert and the maximum thickness of the left insert, and wherein said thickness of the right insert is continuously increasing between the outer edge of the right insert and the maximum thickness of the right insert.

17. The pads of claim 11, wherein said thickness of the left insert is continuously decreasing between the maximum thickness and a thickness at the central axis of the left insert, and wherein said thickness of the right insert is continuously decreasing between the maximum thickness and a thickness at the central axis of the right insert.

18. The pads of claim 11, wherein said maximum thickness of the left or right insert is between 2.5 cm and 2.7 cm.

19. The pads of claim 11, wherein a minimum thickness of the left or right insert is between 0.05 cm and 0.15 cm, wherein the minimum thickness is located at an outer edge of the left or right insert or at said remaining quarter of the area spanned by the left or right insert.

20. The pad of claim 11, wherein said maximum thickness of the left or right insert is about 2.6 cm.

* * * * *